US007878300B2

(12) United States Patent
Sammut et al.

(10) Patent No.: US 7,878,300 B2
(45) Date of Patent: Feb. 1, 2011

(54) INTEGRATED MODULAR EXHAUST SYSTEM

(75) Inventors: Paul H. Sammut, Oakville (CA); Les Freiday, Aurora (CA)

(73) Assignee: Catalytic Combustion Corporation, Bloomer, WI (US)

( * ) Notice: Subject to any disclaimer, the term of this patent is extended or adjusted under 35 U.S.C. 154(b) by 0 days.

(21) Appl. No.: 12/256,610

(22) Filed: Oct. 23, 2008

(65) Prior Publication Data

US 2009/0101434 A1 Apr. 23, 2009

Related U.S. Application Data

(60) Provisional application No. 60/982,103, filed on Oct. 23, 2007.

(51) Int. Cl.
*F01N 13/18* (2010.01)

(52) U.S. Cl. ..... 181/249; 181/238; 181/239; 181/243; 181/250; 181/251

(58) Field of Classification Search ..... 181/227, 181/228, 238, 239, 243, 248, 249, 250, 251, 181/255, 257, 264, 266, 268, 269, 273, 275, 181/276, 282

See application file for complete search history.

(56) References Cited

U.S. PATENT DOCUMENTS 1,822,990 A 9/1931 Gorsline
2,833,368 A * 5/1958 Lowther ..... 181/240
2,940,249 A * 6/1960 Gospodar ..... 60/313
3,189,122 A * 6/1965 Martin ..... 181/238
3,287,900 A * 11/1966 Soltau ..... 60/282
3,378,099 A 4/1968 Gordon
3,650,354 A 3/1972 Gordon
3,703,938 A * 11/1972 Nelson ..... 181/274
3,709,320 A 1/1973 Hollerl et al.
3,749,199 A * 7/1973 Weber ..... 181/236
3,827,529 A * 8/1974 Frietzsche et al. ..... 181/238
3,863,734 A 2/1975 Pawlina
3,968,854 A 7/1976 Gordon et al.
4,064,963 A 12/1977 Kaan et al.
4,133,479 A 1/1979 Musitano et al.
4,164,989 A 8/1979 Lux et al.
4,341,284 A * 7/1982 Moore et al. ..... 181/272
4,949,807 A * 8/1990 Hirata et al. ..... 181/240
5,338,903 A 8/1994 Winberg
5,548,955 A 8/1996 Sandefur et al.
5,732,555 A 3/1998 Gracyalny et al.
6,076,632 A 6/2000 Schuhmacher et al.
6,241,044 B1 * 6/2001 Nishiyama et al. ..... 181/272
6,250,422 B1 6/2001 Goplen et al.
6,382,347 B1 * 5/2002 Gerber ..... 181/227
6,457,553 B1 10/2002 Goplen et al.

(Continued)

*Primary Examiner*—Elvin G Enad
*Assistant Examiner*—Jeremy Luks
(74) *Attorney, Agent, or Firm*—Renner, Kenner, Greive, Bobak, Taylor, < Weber

(57) ABSTRACT

A customizable integrated modular exhaust system is provided having a hollow shell muffler body formed from two symmetrical stamp formed shell members that sealably attach to a tailpipe that transverses the hollow shell, and extends through each end of the hollow shell. Exhaust gases are delivered to the muffler body from an engine, by at least one inlet tube communicably attached to the muffler body and connected to the engine via a flange. The muffler body may have various internal configurations, including a disc baffle or catalytic converter configuration.

14 Claims, 8 Drawing Sheets

U.S. PATENT DOCUMENTS 6,470,998 B1 10/2002 White
6,591,935 B1 * 7/2003 Petley ..... 180/309
6,832,665 B2 * 12/2004 Crombeen ..... 181/275
6,892,853 B2 * 5/2005 Cai et al. ..... 181/249
6,959,782 B2 11/2005 Brower et al.
7,104,359 B1 9/2006 Zelinski
2004/0089500 A1 * 5/2004 Lewis ..... 181/249
2006/0219476 A1 * 10/2006 Southway et al. ..... 181/269

* cited by examiner

INTEGRATED MODULAR EXHAUST SYSTEM

CROSS REFERENCE TO RELATED APPLICATIONS

This application claims the benefit of U.S. Provisional Patent Application No. 60/982,103, filed Oct. 23, 2007, the disclosure of which is incorporated herein by reference.

FIELD OF THE INVENTION

The invention relates to exhaust systems, and more particularly to a modular exhaust system for off-road applications.

BACKGROUND OF THE INVENTION

Internal combustion engines are used to power a wide array of "off-road" applications, such as lawn mowers, chainsaws and leaf blowers. Exhaust systems are provided for these engines to guide waste gases away from the engine. These systems typically direct waste gases through an inlet tube to a muffler to silence the noise of the escaping exhaust gases, before they are expelled from an outlet. Mufflers known in the art generally comprise a number of separately manufactured components including a housing that encloses multiple internal baffles and tubes.

Exhaust systems known in the art are expensive to manufacture due to the complexity of the systems and particularly the complexity of the muffler. This expense is further increased since exhaust systems are typically tailored for individual off-road engine designs, which vary considerably between applications and manufacturers. Consequently, for many off-road applications the exhaust system may account for a large portion of the total manufacturing expense.

Accordingly, there is a need in the art for a customizable exhaust system that provides reduced assembly complexity, which is also capable of being used effectively with a number of different engine models.

SUMMARY OF THE INVENTION

The present invention is a customizable modular exhaust system that provides reduced manufacturing complexity, making it more economical to fabricate than traditional stamped mufflers. Unlike typical stamped mufflers that use multiple internal baffles and tubes to silence exhaust noise, this invention provides a streamlined modular exhaust system that eliminates the need for many traditional components, such as multiple internal tubes and end caps. The invention also permits manufacturing procedures to be further simplified by using symmetrical parts in the exhaust system that are substantially the same shape and size, that can be stamp formed on a single dye. This reduces the need for multiple tooling and manufacturing processes. Manufacturing expense can be further reduced by using a modular exhaust system that can be adapted for use with multiple engine designs.

According to a first aspect of the invention, a modular exhaust system is provided for use with an engine, comprising:

a muffler body comprising:

first and second symmetrical concave stamp formed shell members, the first shell member containing portions defining at least one inlet hole, said shell members cooperating to define a hollow shell having first and second opposing ends, the first end containing portions defining a first end opening;

a tailpipe having a first and second end, the tailpipe internally traversing the hollow shell, the first end of the tailpipe extending through the first end opening of the hollow shell, the tailpipe having a first tailpipe section outside the first end of the hollow shell sealably connected to the portions of the hollow shell defining the first end opening of the hollow shell, and a second tailpipe section within the hollow shell, the second tailpipe section having portions defining a plurality of perforations;

a transfer tube having a first and second end, a transfer tube diameter greater than the tailpipe diameter and a length smaller than the length of the second tailpipe section, the transfer tube attached to the second tailpipe section encircling the region of the second tailpipe section defining a plurality of perforations;

one inlet tube for each inlet hole of the first shell member of the hollow shell, each inlet tube having a first and second end, the first end communicably attached to the muffler body to allow gas to flow into the muffler body through the inlet hole;

one connector for each inlet tube, the connector attached to the second end of the inlet tube allowing the inlet tube to be communicably attached to an engine to allow for the flow of exhaust gas from the engine to the muffler body.

An end plug may be sealably attached to one of the first or second tailpipe ends to provide a single outlet design of the modular exhaust system.

The modular exhaust system may contain twin inlets, with the first shell member of the hollow shell containing portions defining a first inlet hole proximal to the first end of the hollow shell and portions defining a second inlet hole proximal to the second end of the hollow shell.

The modular exhaust system may further comprise at least one disc baffle attached to the tailpipe. A first disc baffle may be attached to the second tailpipe section proximal to the first end of the transfer tube and a second disc baffle may be attached to the second tailpipe section proximal to the second end of the transfer tube, the first and second disc baffles defining a first compartment within the hollow shell between the first end of the hollow shell and first disc baffle, a second compartment between the second end of the hollow shell and second disc baffle and a third compartment between the first and second disc baffles, the first inlet hole of the first shell member opening into the first compartment, the second inlet hole opening into the second compartment.

According to a second aspect of the invention, a modular exhaust system is provided for use with an engine, comprising:

a muffler body comprising:

first and second symmetrical concave stamp formed shell members, having rim portions that oppose one another, said shell members cooperating to define a hollow shell having first and second opposing ends, the first end containing portions defining a first end opening, the second end containing portions defining a second end opening, the first shell member containing portions defining a first inlet hole proximal to the first end of the hollow shell and a second inlet hole proximal to the second end of the hollow shell, the second shell member containing portions defining a central outlet hole;

a tailpipe having a first and second end, the tailpipe internally traversing the hollow shell, the first end of the tailpipe extending through the first end opening of the hollow shell, the second end of the tailpipe extending through the second end opening of the hollow shell, the tailpipe having a first tailpipe section outside the first end of the hollow shell sealably connected to the portions of the hollow shell defining the first end opening of the hollow shell, a second tailpipe section outside the second end of the hollow shell sealably connected to the portions of the hollow shell defining the second end opening of the hollow shell and a third tailpipe section within the hollow shell, the third tailpipe section having portions defining a plurality of perforations;

a transfer tube having a first and second end, a transfer tube diameter greater than the tailpipe diameter and a length smaller than the length of the third tailpipe section, the transfer tube attached to the third tailpipe section encircling the region of the third tailpipe section defining a plurality of perforations;

first and second disc baffles the first disc baffle attached to the tailpipe proximal to the first end of the transfer tube, the second disc baffle attached to the tailpipe proximal to the second end of the transfer tube, the first and second disc baffles defining a first compartment within the hollow shell between the first end of the hollow shell and first disc baffle, a second compartment between the second end of the hollow shell and second disc baffle and a third compartment between the first and second disc baffles, the first inlet hole of the first shell member opening into the first compartment, the second inlet hole opening into the second compartment, the central outlet hole of the second shell member opening into the third compartment;

first and second end plugs, the first end plug sealably attached to the first tailpipe end, the second end plug sealably attached to the second tailpipe end;

a diffuser tube communicably attached to the muffler body to allow gas to exit the muffler body through the central outlet hole of the second shell member;

first and second inlet tubes having first and second ends, the first end of the first inlet tube communicably attached to the muffler body to allow gas to flow into the muffler body through the first inlet hole, the first end of the second inlet tube communicably attached to the muffler body to allow gas to flow into the muffler body through the second inlet hole;

first and second connectors, the first connector attached to the second end of the first inlet tube, the second connector attached to the second end of the second inlet tube, the connectors allowing the inlet tubes to be communicably attached to an engine to allow for the flow of exhaust gas from the engine to the muffler body.

According to a third aspect of the invention, a modular exhaust system is provided for use with an engine, comprising:

a muffler body comprising:

first and second symmetrical concave stamp formed shell members, having rim portions that oppose one another, said shell members cooperating to define a hollow shell having first and second opposing ends, the first end containing portions defining a first end opening, the second end containing portions defining a second end opening, the first shell member containing portions defining at least one inlet hole distal to the second end of the hollow shell, the second shell member containing portions defining an outlet hole proximal to the second end of the hollow shell;

a tailpipe having a first and second end, the tailpipe internally traversing the hollow shell, the first end of the tailpipe extending through the first end opening of the hollow shell, the second end of the tailpipe extending through the second end opening of the hollow shell, the tailpipe having a first tailpipe section outside the first end of the hollow shell sealably connected to the portions of the hollow shell defining the first end opening of the hollow shell, a second tailpipe section outside the second end of the hollow shell sealably connected to the portions of the hollow shell defining the second end opening of the hollow shell and a third tailpipe section within the hollow shell, the third tailpipe section having first and second portions defining a plurality of perforations;

a transfer tube having a first and second end, a transfer tube diameter greater than the tailpipe diameter, the transfer tube attached to the third tailpipe section encircling the first portion of the third tailpipe section defining a plurality of perforations;

a disc baffle attached to the tailpipe proximal to the second end of the transfer tube, the disc baffle defining a first compartment within the hollow shell between the first end of the hollow shell and the disc baffle and a second compartment between the second end of the hollow shell and the disc baffle, the at least one inlet hole of the first shell member opening into the first compartment, the first portion of the third tailpipe section defining a plurality of perforations located within the first compartment, the outlet hole of the second shell member opening into the second compartment, the second portion of the third tailpipe section defining a plurality of perforations located within the second compartment;

first and second end plugs, the first end plug sealably attached to the first tailpipe end, the second end plug sealably attached to the second tailpipe end;

a diffuser tube communicably attached to the muffler body to allow exhaust gas to exit the muffler body through the outlet hole;

one inlet tube for each inlet hole of the first shell member, each inlet tube having a first and second end, the first end communicably attached to the muffler body to allow for the flow of gas into the muffler body through the inlet hole;

one connector for each inlet tube, the connector attached to the second end of the inlet tube allowing the inlet tube to be communicably attached to an engine to allow for the flow of exhaust gas from the engine to the muffler body.

The modular exhaust system may comprise twin inlets, wherein the first shell contains portions defining a first and second inlet hole, the first and second inlet holes opening into the first compartment of the hollow shell. Alternatively, the modular exhaust system may contain a single inlet, wherein the first shell member contains portions defining a single inlet hole, the single inlet hole opening into the first compartment of the hollow shell.

According to a fourth aspect of the invention, a modular exhaust system is provided for use with an engine, comprising:

a muffler body comprising:

first and second symmetrical concave stamp formed shell members, having rim portions that oppose one another, the first shell member containing portions defining at least one inlet hole, said shell members cooperating to define a hollow shell having first and second opposing ends, the first end containing portions defining a first end opening, the second end containing portions defining a second end opening;

a tailpipe having a first and second end, the tailpipe internally traversing the hollow shell, the first end of the tailpipe extending through the first end opening of the hollow shell, the second end of the tailpipe extending through the second end opening of the hollow shell, the tailpipe having a first tailpipe section outside the first end of the hollow shell sealably connected to the portions of the hollow shell defining the first end opening of the hollow shell, a second tailpipe section outside the second end of the hollow shell sealably connected to the portions of the hollow shell defining the second end opening of the hollow shell and a third tailpipe section within the hollow shell, the third tailpipe section having a first portion proximal to the first end of the hollow shell defining a plurality of perforations and a second portion distal to the first end of the hollow shell defining a plurality of perforations;

an end element attached to the first end of the tailpipe;

a catalytic element having a diameter greater than the tailpipe diameter, the catalytic element attached to the third tailpipe section encircling the portion of the third tailpipe section defining a plurality of perforations distal to the first end of the hollow shell;

one inlet tube for each inlet hole of the first shell member, each inlet tube having a first and second end, the first end communicably attached to the muffler body to allow for the flow of gas into the muffler body through the inlet hole;

one connector for each inlet tube, the connector attached to the second end of the inlet tube allowing the inlet tube to be communicably attached to an engine to allow for the flow of exhaust gas from the engine to the muffler body.

The end element of the modular exhaust system may be an end plug sealably attached to the end of the tailpipe. Alternatively the end element may be a venturi.

BRIEF DESCRIPTION OF THE FIGURES

Embodiments of the invention will be described by way of example and with reference to the drawings in which.

DETAILED DESCRIPTION OF THE FIGURES

As shown in the figures, the present invention relates to a modular exhaust system that provides reduced manufacturing complexity.

Figure 1:
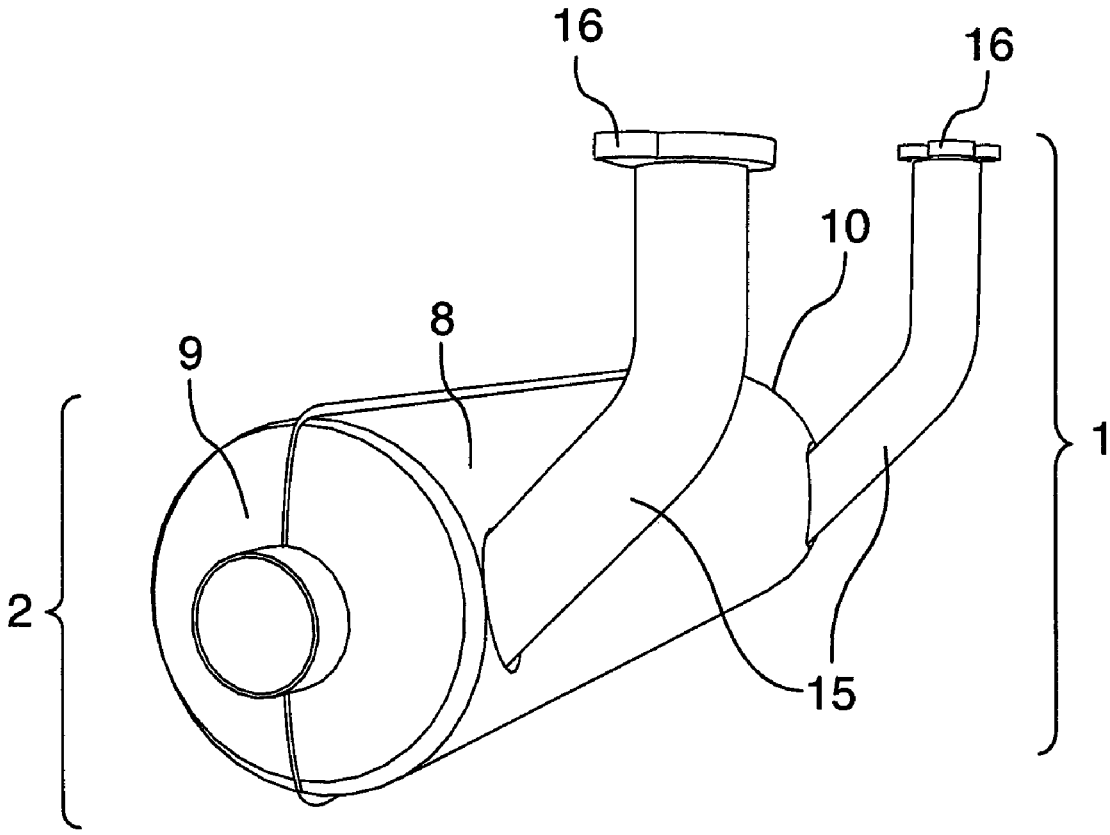
FIG. 1 is a perspective view of one embodiment of the modular exhaust system of the present invention, with twin inlets.
Figure 2:
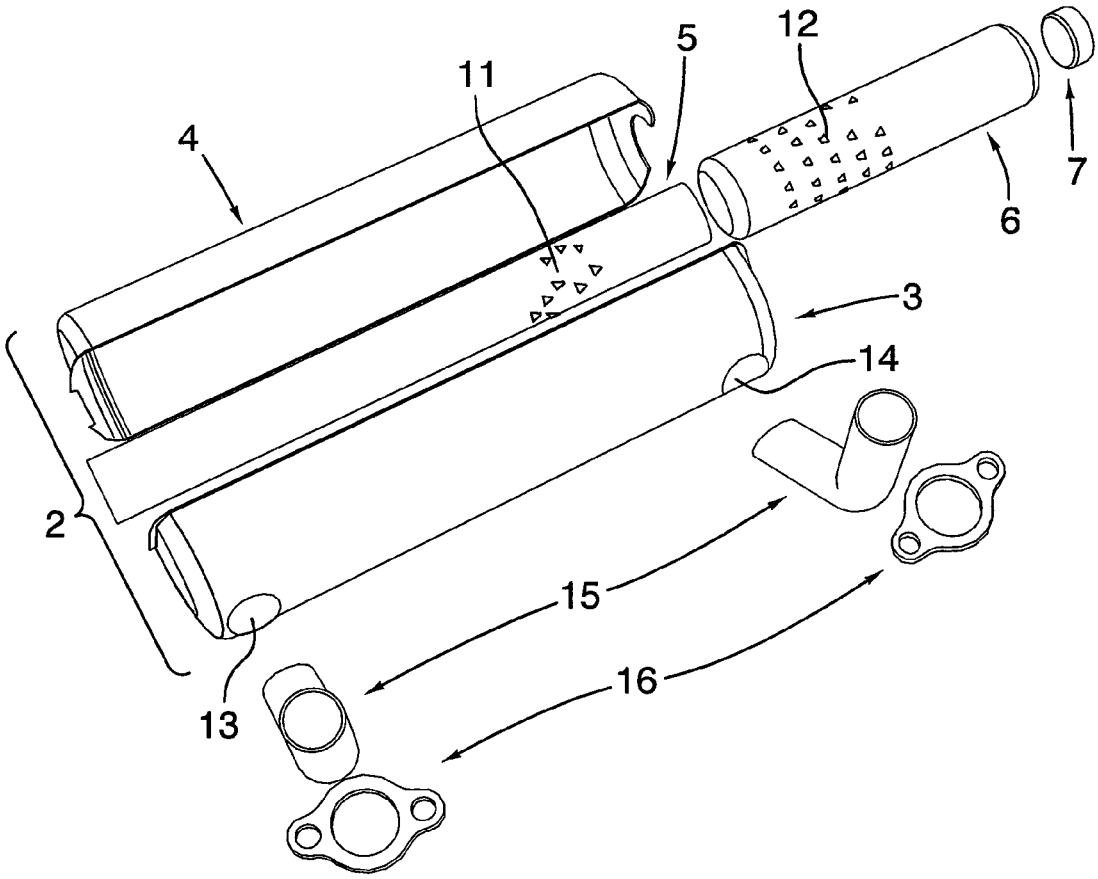
FIG. 2 is an exploded perspective view of one embodiment of the modular exhaust system of the present invention with a standard baffle assembly.
Figure 3:
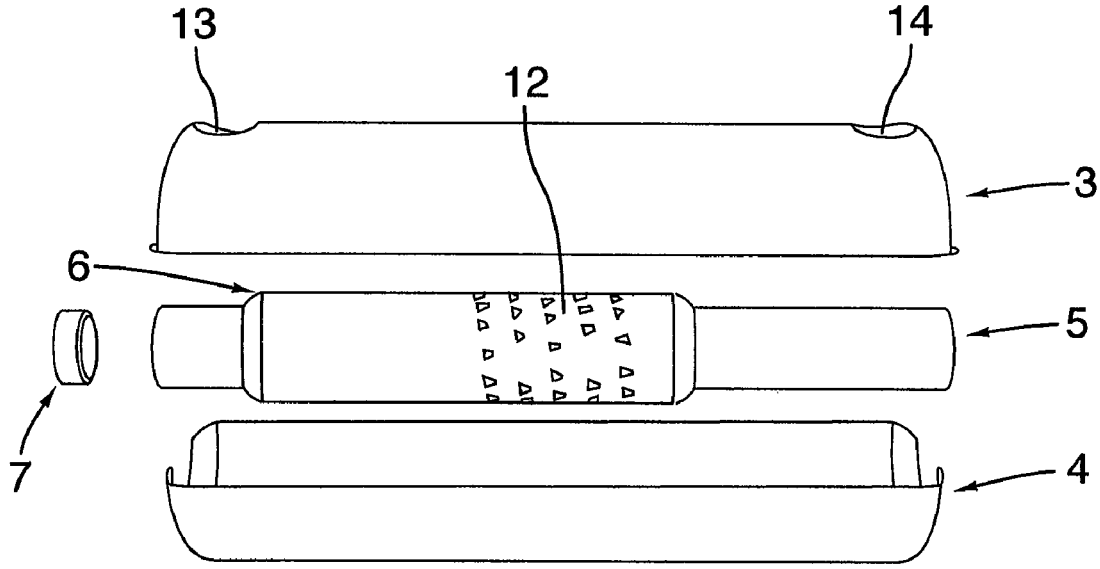
FIG. 3 is an exploded perspective view of the internal configuration of one embodiment of the modular exhaust system of the present invention, with a standard baffle assembly and a blocked outlet.

FIG. 1, FIG. 2 and FIG. 3 show one embodiment of the modular exhaust system I of the invention, having a muffler body 2 formed from a first concave stamp formed shell member 3, a symmetrical second concave stamp formed shell member 4, a tailpipe 5, transfer tube 6 and a first end plug 7. The symmetrical concave stamped formed shell members 3 and 4 are symmetrical in that they are substantially the same shape and size and can be stamp formed on a single dye. The symmetrical stamp formed shells 3 and 4 have opposing rims and cooperate to form a hollow shell 8, having a first end 9, with portions defining a first end opening, and a second end 10, with portions defining a second end opening. The length and diameter of the symmetrical stamp formed shells 3 and 4 may be modified to accommodate a wide range of engine types.

Tailpipe 5 of the modular exhaust system 1 transverses the hollow shell 8 of the muffler body 2, extending through the opening in the first end 9 and the opening in the second end 10 of the hollow shell 8. The tailpipe 5 contains a perforated region 11 located inside the hollow shell 8. Known methods in the art may be used to select the size and number of perforations in the tailpipe region 11 to provide a desired back pressure and sound. The transfer tube 6 encircles and is attached to the perforated region 11 of the tailpipe 5. The transfer tube 6 may either have a perforated region 12 as depicted in FIG. 2 and FIG. 3 or an open end or ends to allow for exhaust gas flow. The first end plug 7 is sealably attached to one end of the tailpipe 5. The tailpipe 5, transfer tube 6 and first end plug 7 cooperate as a standard baffle assembly. While a single outlet design is depicted in FIG. 1, FIG. 2 and FIG. 3, the modular exhaust system I can also accommodate a twin outlet design in which both ends of the tailpipe are unplugged.

The muffler body 2 is formed by aligning and clamping the standard baffle assembly between the concave stamp formed shell members 3 and 4 and sealing the perimeter of the stamped formed shell members by a means such as, metal inert gas (MIG), tungsten inert gas (TIG), laser, electrical resistance or friction welding. This process sealably attaches the tailpipe 5 to the hollow shell 8 at the first end 9 and second end 10.

The first concave stamp formed shell member 3 of the muffler body 2 has a first inlet hole 13 and second inlet hole 14, which may be stamped out in an operation independent of the stamping of the first concave shell member 3. The location of inlet holes 13 and 14 are not limited to that shown in FIG. 1, FIG. 2 and FIG. 3, but include any other suitable location (s). Inlet tubes 15 are communicably connected at one end to the muffler body 2 and deliver exhaust gases from an engine to the muffler body 2 through the inlet holes 13 and 14. The other end of the inlet tubes 15 are attached to flanges 16 that allow the inlet tubes to be communicably attached to an engine to receive exhaust gases. While a twin inlet design is depicted in FIG. 1, FIG. 2 and FIG. 3 the modular exhaust system of the invention can also accommodate a single inlet design. The muffler body 2, inlet tubes 15 and flanges 16 may be connected on a fixture that sets the location of the muffler body 2 in relation to the flanges 16 to give modular exhaust system 1.

Figure 4:
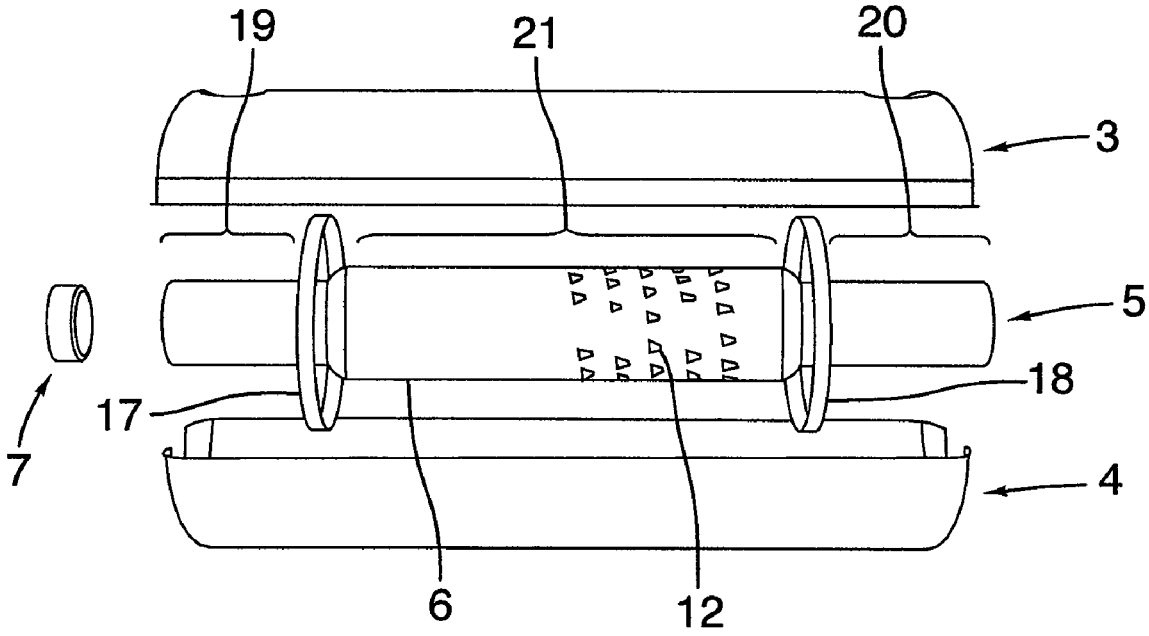
FIG. 4 is an exploded perspective view of the internal configuration of one embodiment of the modular exhaust system of the present invention, with a standard baffle assembly, disc baffles and a blocked outlet.

FIG. 4 shows another embodiment of the modular exhaust system 1 of the invention, further comprising an added first disc baffle 17 and a second disc baffle 18, which increase sound attenuation and back pressure. The disc baffles 17 and 18 are attached to the tailpipe 5 and compartmentalize the hollow shell 8 into three compartments. The first compartment 19 extends from the inner wall of the first end 9 of the hollow shell 8 to the first baffle 17. The second compartment 20 extends from the inner wall of the second end 10 of the hollow shell 8 to the second baffle 18. The third compartment 21 extends from the first baffle 17 to the second baffle 18 and contains the transfer tube 6. The first inlet hole 13 of the first concave stamp formed shell member 3 opens into the first compartment 19, and the second inlet hole 14 opens into the second compartment 20, allowing exhaust gases to enter the first compartment 19 and second compartment 20 respectively. The disc baffles 17 and 18 may either be perforated as depicted in FIG. 4, or may be solid. When the disc baffles 17 and 18 are perforated, exhaust gases that enter the first compartment 19 and second compartment 20 travel through the perforated disc baffles 17 and 18 into the third compartment 21. The exhaust gases are then directed to transfer tube 6 and then tailpipe 5. The exhaust gases then exit the muffler body from the unplugged end of the tailpipe 5. If solid disc baffles 17 and 18 are employed, the portions of the tailpipe within the first compartment 19 and second compartment 20 contain additional perforations that allow exhaust gases to flow into the tailpipe 5.

Figure 5:
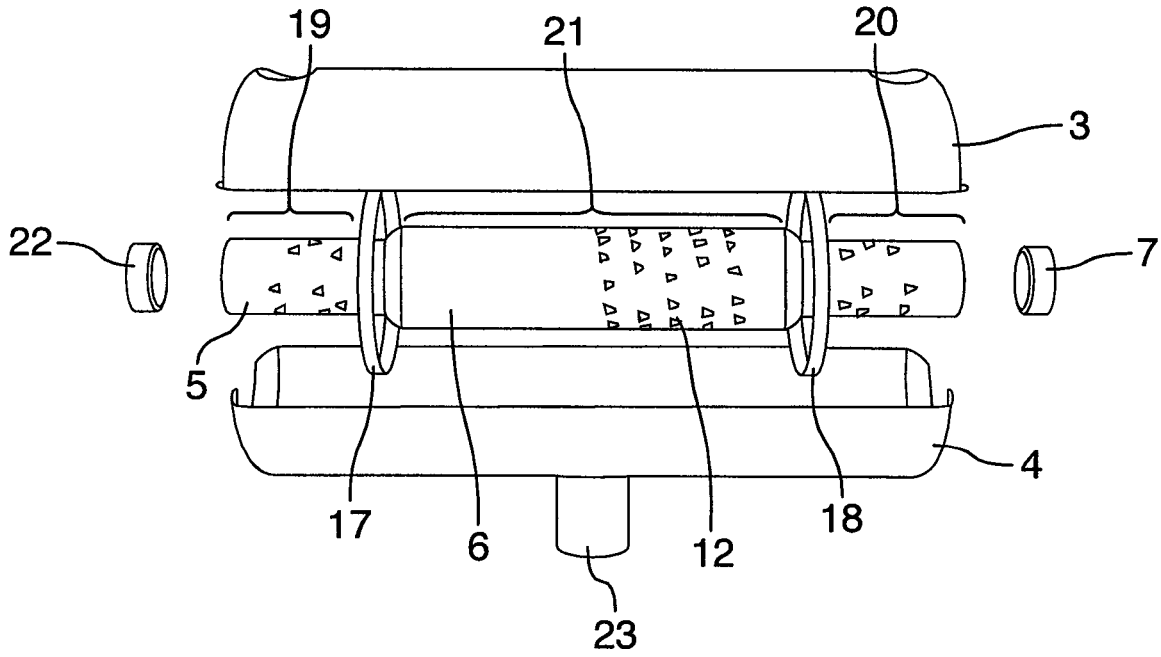
FIG. 5 is an exploded perspective view of the internal configuration of one embodiment of the modular exhaust system of the present invention, with a center outlet through the shell wall.

FIG. 5 shows another embodiment of the modular exhaust system 1, with an inlet and baffle design identical to that shown in FIG. 4. In this embodiment the unplugged end of the tailpipe 5 is sealably plugged with a second end plug 22. Exhaust gases enter the first compartment 19 and second compartment 20 of the muffler body 2 and travel to the third compartment 21 in the same manner as that described for the embodiment shown in FIG. 4. The exhaust gases exit the muffler body 2 from the third compartment 21 of the hollow body 8 through a central outlet hole in the second concave stamp formed shell member 4. A diffuser tube 23 is communicably attached to the muffler body 2 and receives the exiting gas through the central outlet hole.

Figure 6:
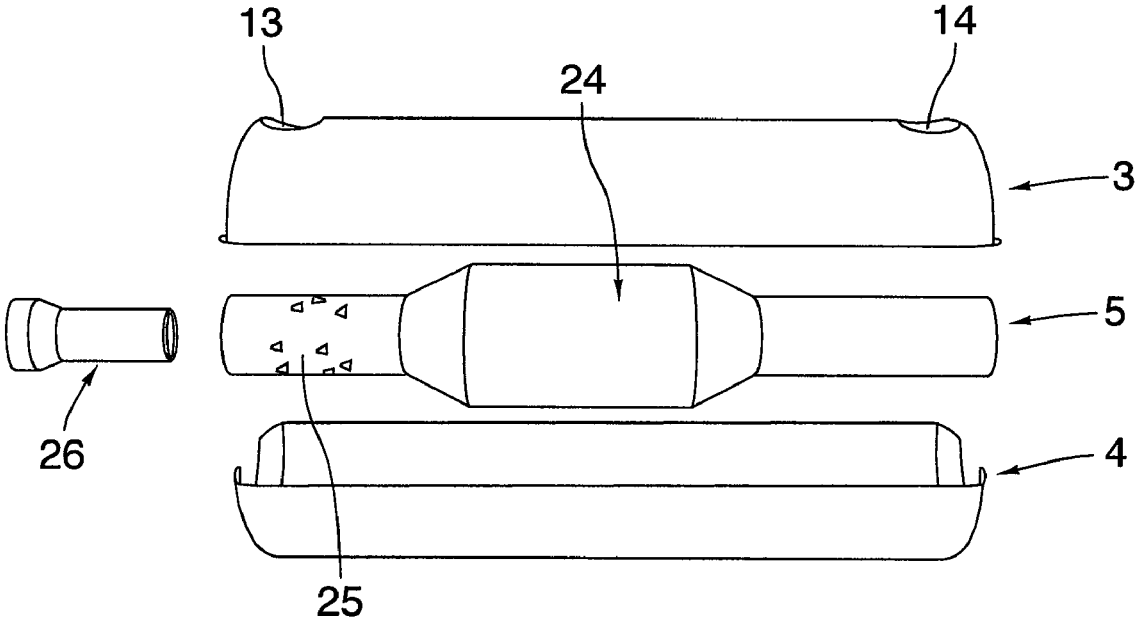
FIG. 6 is an exploded perspective view of the internal configuration of one embodiment of the modular exhaust system of the present invention, with a catalytic element and venturi.

FIG. 6 shows another embodiment of the modular exhaust system 1 in which a catalytic element 24 replaces the standard baffle assembly. The catalytic element 24 encircles and is attached to the first perforated region 11 of the tailpipe 5. The tailpipe 5 contains a second perforated region 25 located between the first end 9 of the hollow shell 8 and the catalytic element 24. The end of the tailpipe 5 extending through the first end 9 of the hollow shell 8 is attached to an end element, such as first end cap 7 or a venturi 26 as show in FIG. 6, which increases the efficiency of the catalytic element 24 by introducing fresh air into the catalytic element 24 through the tailpipe 5. Exhaust gases enter the hollow shell 8 through the inlet holes 13 and 14 of the first shell member 3 and then enter the tailpipe 5 through the second perforated region 25. The gases then travel through the catalytic element 24 and exit the tailpipe 5 from the end of the tailpipe 5 extending through the second end wall 10. While a twin inlet design is depicted in FIG. 6 the modular exhaust system 1 can also accommodate a single inlet design with a single inlet hole in the first shell member 3.

Figure 7:
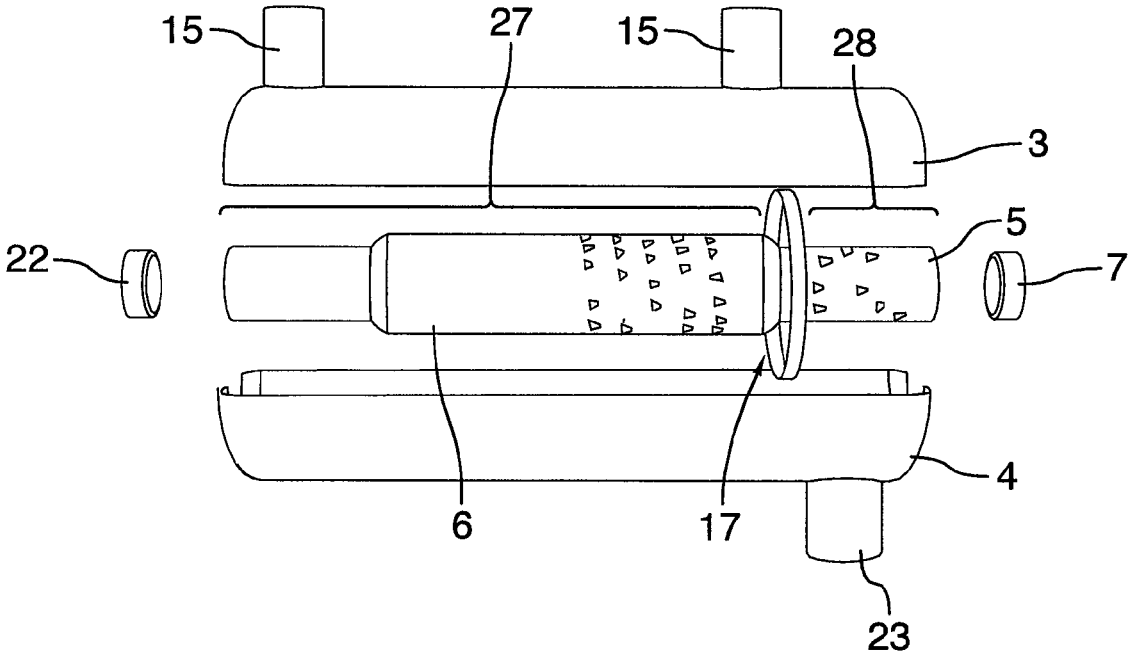
FIG. 7 is an exploded perspective view of the internal configuration of one embodiment of the modular exhaust system of the present invention, with a dual inlet and single side outlet through the shell wall.
Figure 8:
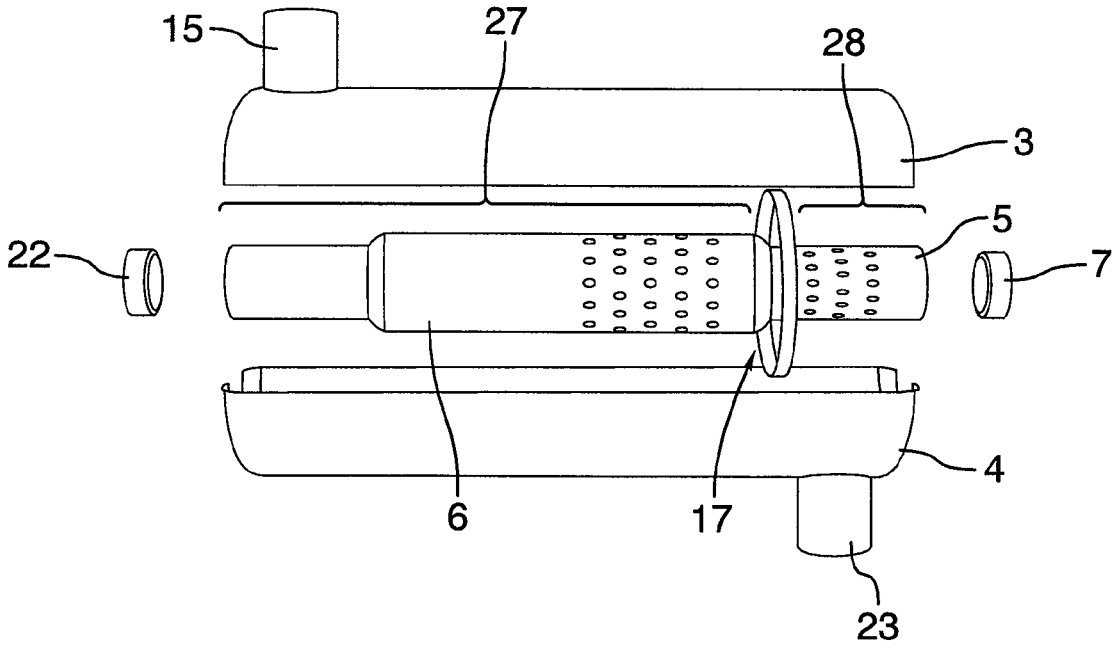
FIG. 8 is an exploded perspective view of the internal configuration of one embodiment of the modular exhaust system of the present invention, with a single inlet and single side outlet through the shell wall.

FIG. 7 shows another embodiment of the modular exhaust system 1, with a standard baffle assembly and single first disc baffle 17 attached to the tailpipe 5 proximal to the end of the transfer tube 6 that is proximal to the second end 10 of the hollow shell 8. The first disc baffle 17 compartmentalizes the hollow shell 8 into a first compartment 27 and second compartment 28. The first compartment 27 extends from the inner wall of the first end 9 of the hollow shell 8 to the first baffle 17. The second compartment 28 extends from the inner wall of the second end 10 of the hollow shell 8 to the first baffle 17. Exhaust gases are delivered to the first compartment 27 of the hollow body 8 by inlet tubes 15 and enter the hollow shell 8 through inlet holes 13 and 14. While a twin outlet design is depicted in FIG. 7 the described embodiment of the modular exhaust system 1 of the invention can also accommodate a single inlet design as shown in FIG. 8, in which a single inlet tube 15 delivers exhaust gases to the first compartment of the hollow shell 8. Once in the hollow shell 8, the gases are directed to transfer tube 6 and then tailpipe 5. The gases flow through the tailpipe 5 from the first compartment 27 to the second compartment 28 and then exit the hollow shell 8 through the diffuser tube 23.

The foregoing embodiments are considered as illustrative only of the principles of the invention. Further, since numerous modifications and changes will readily occur to those skilled in the art, the described embodiments are not desired to limit the invention to the exact components shown and described, and accordingly, all suitable modifications and equivalents may be resorted to, falling within the scope of the invention and the appended claims and their equivalents.

What is claimed is:

1. A modular exhaust system for use with an engine, comprising:

a muffler body comprising:

first and second concave stamp formed shell members, the first shell member containing portions defining at least one inlet hole, said shell members cooperating to define a hollow shell having first and second opposing ends, the first end containing portions defining a first end opening;

a tailpipe having a first and second end, the tailpipe internally traversing the hollow shell, the first end of the tailpipe extending through the first end opening of the hollow shell, the tailpipe having a first tailpipe section outside the first end of the hollow shell sealably connected to the portions of the hollow shell defining the first end opening of the hollow shell, and a second tailpipe section within the hollow shell, the second tailpipe section having portions defining a plurality of perforations;

a transfer tube having a first and second end, a transfer tube diameter greater than the tailpipe diameter and a length smaller than the length of the second tailpipe section, the transfer tube attached to the second tailpipe section encircling the region of the second tailpipe section defining a plurality of perforations;

one inlet tube for each inlet hole of the first shell member of the hollow shell, each inlet tube having a first and second end, the first end communicably attached to the muffler body to allow gas to flow into the muffler body through the inlet hole;

one connector for each inlet tube, the connector attached to the second end of the inlet tube allowing the inlet tube to be communicably attached to an engine to allow for the flow of exhaust gas from the engine to the muffler body.

2. The modular exhaust system of claim 1 further comprising an end plug sealably attached to one of the first or second tailpipe ends.

3. The modular exhaust system of claim 2 wherein the first shell member of the hollow shell contains portions defining a first inlet hole proximal to the first end of the hollow shell and portions defining a second inlet hole proximal to the second end of the hollow shell.

4. The modular exhaust system of claim 3 further comprising at least one disc baffle attached to the tailpipe.

5. The modular exhaust system of claim 4 wherein a first disc baffle is attached to the third tailpipe section proximal to the first end of the transfer tube and a second disc baffle is attached to the third tailpipe section proximal to the second end of the transfer tube, the first and second disc baffles defining a first compartment within the hollow shell between the first end of the hollow shell and first disc baffle, a second compartment between the second end of the hollow shell and second disc baffle and a third compartment between the first and second disc baffles, the first inlet hole of the first shell member opening into the first compartment, the second inlet hole opening into the second compartment.

6. The modular exhaust system of claim 1, wherein the transfer tube is a catalytic element.

7. The modular exhaust system of claim 1, wherein the second tailpipe section has a first portion proximal to the first end of the hollow shell defining a plurality of perforations and a second portion distal to the first end of the hollow shell defining a plurality of perforations.

8. A modular exhaust system for use with an engine, comprising:

a muffler body comprising:

first and second symmetrical concave stamp formed shell members, having rim portions that oppose one another, said shell members cooperating to define a hollow shell having first and second opposing ends, the first end containing portions defining a first end opening, the second end containing portions defining a second end opening, the first shell member containing portions defining a first inlet hole proximal to the first end of the hollow shell and a second inlet hole proximal to the second end of the hollow shell, the second shell member containing portions defining a central outlet hole;

a tailpipe having a first and second end, the tailpipe internally traversing the hollow shell, the first end of the tailpipe extending through the first end opening of the hollow shell, the second end of the tailpipe extending through the second end opening of the hollow shell, the tailpipe having a first tailpipe section outside the first end of the hollow shell sealably connected to the portions of the hollow shell defining the first end opening of the hollow shell, a second tailpipe section outside the second end of the hollow shell sealably connected to the portions of the hollow shell defining the second end opening of the hollow shell and a third tailpipe section within the hollow shell, the third tailpipe section having portions defining a plurality of perforations;

a transfer tube having a first and second end, a transfer tube diameter greater than the tailpipe diameter and a length smaller than the length of the third tailpipe section, the transfer tube attached to the third tailpipe section encircling the region of the third tailpipe section defining a plurality of perforations;

first and second disc baffles the first disc baffle attached to the tailpipe proximal to the first end of the transfer tube, the second disc baffle attached to the tailpipe proximal to the second end of the transfer tube, the first and second disc baffles defining a first compartment within the hollow shell between the first end of the hollow shell and first disc baffle, a second compartment between the second end of the hollow shell and second disc baffle and a third compartment between the first and second disc baffles, the first inlet hole of the first shell member opening into the first compartment, the second inlet hole opening into the second compartment, the central outlet hole of the second shell member opening into the third compartment;

first and second end plugs, the first end plug sealably attached to the first tailpipe end, the second end plug sealably attached to the second tailpipe end;

a diffuser tube communicably attached to the muffler body to allow gas to exit the muffler body through the central outlet hole of the second shell member;

first and second inlet tubes having first and second ends, the first end of the first inlet tube communicably attached to the muffler body to allow gas to flow into the muffler body through the first inlet hole, the first end of the second inlet tube communicably attached to the muffler body to allow gas to flow into the muffler body through the second inlet hole;

first and second connectors, the first connector attached to the second end of the first inlet tube, the second connector attached to the second end of the second inlet tube, the connectors allowing the inlet tubes to be communicably attached to an engine to allow for the flow of exhaust gas from the engine to the muffler body.

9. A modular exhaust system for use with an engine, comprising:

a muffler body comprising:

first and second symmetrical concave stamp formed shell members, having rim portions that oppose one another, said shell members cooperating to define a hollow shell having first and second opposing ends, the first end containing portions defining a first end opening, the second end containing portions defining a second end opening, the first shell member containing portions defining at least one inlet hole distal to the second end of the hollow shell, the second shell member containing portions defining an outlet hole proximal to the second end of the hollow shell;

a tailpipe having a first and second end, the tailpipe internally traversing the hollow shell, the first end of the tailpipe extending through the first end opening of the hollow shell, the second end of the tailpipe extending through the second end opening of the hollow shell, the tailpipe having a first tailpipe section outside the first end of the hollow shell sealably connected to the portions of the hollow shell defining the first end opening of the hollow shell, a second tailpipe section outside the second end of the hollow shell sealably connected to the portions of the hollow shell defining the second end opening of the hollow shell and a third tailpipe section within the hollow shell, the third tailpipe section having first and second portions defining a plurality of perforations;

a transfer tube having a first and second end, a transfer tube diameter greater than the tailpipe diameter, the transfer tube attached to the third tailpipe section encircling the first portion of the third tailpipe section defining a plurality of perforations;

a disc baffle attached to the tailpipe proximal to the second end of the transfer tube, the disc baffle defining a first compartment within the hollow shell between the first end of the hollow shell and the disc baffle and a second compartment between the second end of the hollow shell and the disc baffle, the at least one inlet hole of the first shell member opening into the first compartment, the first portion of the third tailpipe section defining a plurality of perforations located within the first compartment, the outlet hole of the second shell member opening into the second compartment, the second portion of the third tailpipe section defining a plurality of perforations located within the second compartment;

first and second end plugs, the first end plug sealably attached to the first tailpipe end, the second end plug sealably attached to the second tailpipe end;

a diffuser tube communicably attached to the muffler body to allow exhaust gas to exit the muffler body through the outlet hole;

one inlet tube for each inlet hole of the first shell member, each inlet tube having a first and second end, the first end communicably attached to the muffler body to allow for the flow of gas into the muffler body through the inlet hole;

one connector for each inlet tube, the connector attached to the second end of the inlet tube allowing the inlet tube to be communicably attached to an engine to allow for the flow of exhaust gas from the engine to the muffler body.

10. The modular exhaust system of claim 9 wherein the first shell contains portions defining a first and second inlet hole, the first and second inlet holes opening into the first compartment of the hollow shell.

11. The modular exhaust system of claim 9 wherein the first shell member contains portions defining a single inlet hole, the single inlet hole opening into the first compartment of the hollow shell.

12. A modular exhaust system for use with an engine, comprising:

a muffler body comprising:

first and second symmetrical concave stamp formed shell members, having rim portions that oppose one another, the first shell member containing portions defining at least one inlet hole, said shell members cooperating to define a hollow shell having first and second opposing ends, the first end containing portions defining a first end opening, the second end containing portions defining a second end opening;

a tailpipe having a first and second end, the tailpipe internally traversing the hollow shell, the first end of the tailpipe extending through the first end opening of the hollow shell, the second end of the tailpipe extending through the second end opening of the hollow shell, the tailpipe having a first tailpipe section outside the first end of the hollow shell sealably connected to the portions of the hollow shell defining the first end opening of the hollow shell, a second tailpipe section outside the second end of the hollow shell sealably connected to the portions of the hollow shell defining the second end opening of the hollow shell and a third tailpipe section within the hollow shell, the third tailpipe section having a first portion proximal to the first end of the hollow shell defining a plurality of perforations and a second portion distal to the first end of the hollow shell defining a plurality of perforations;

an end element attached to the first end of the tailpipe;

a catalytic element having a diameter greater than the tailpipe diameter, the catalytic element attached to the third tailpipe section encircling the portion of the third tailpipe section defining a plurality of perforations distal to the first end of the hollow shell;

one inlet tube for each inlet hole of the first shell member, each inlet tube having a first and second end, the first end communicably attached to the muffler body to allow for the flow of gas into the muffler body through the inlet hole;

one connector for each inlet tube, the connector attached to the second end of the inlet tube allowing the inlet tube to be communicably attached to an engine to allow for the flow of exhaust gas from the engine to the muffler body.

13. The modular exhaust system of claim 12 wherein the end element is an end plug sealably attached to the first end of the tailpipe.

14. The modular exhaust system of claim 12 wherein the end element is a venturi.

* * * * *